United States Patent [19]

Ellsworth

[11] 4,385,758

[45] May 31, 1983

[54] BEAD CHAIN STACKER

[75] Inventor: Daniel H. Ellsworth, Broad Brook, Conn.

[73] Assignee: Scan Optics, East Hartford, Conn.

[21] Appl. No.: 272,215

[22] Filed: Jun. 10, 1981

[51] Int. Cl.[3] ..... B65H 31/20

[52] U.S. Cl. ..... 271/224; 271/182

[58] Field of Search ..... 271/207, 220, 223, 224, 271/182; 493/410, 411, 414

[56] References Cited

U.S. PATENT DOCUMENTS

| | | | |
|---|---|---|---|
| 470,898 | 3/1892 | Reiffel | 271/224 |
| 2,995,366 | 8/1961 | Maidment | 271/220 X |
| 3,460,825 | 8/1969 | Mets | 493/411 |
| 4,054,235 | 10/1977 | Witcher | 493/410 X |

*Primary Examiner*—Richard A. Schacher

*Attorney, Agent, or Firm*—Brumbaugh, Graves, Donohue & Raymond

[57] ABSTRACT

A document stacking bin receives and stacks documents injected therein along a free flight path. The bin includes an energy absorbing device for intercepting the documents in free flight, absorbing their kinetic energy and allowing them to free fall onto a stack. The energy absorbing device includes at least one bead chain having one end fixed and the other end looped over a portion of the bin and attached to a weight.

10 Claims, 2 Drawing Figures

BEAD CHAIN STACKER

BACKGROUND OF THE INVENTION

The present invention relates to document handling equipment and, more particularly, to devices for stacking documents exiting from such document handling equipment.

Mechanical devices for moving documents at high speed as part of a system that reads or operates on the documents are well known. Such systems include photocopiers, optical character readers and sorters. A typical system of this type will accept a stack of documents at its input. These documents are fed into the system automatically, processed, and then ejected into one or more output stacks.

U.S. Pat. No. 4,171,129 to Daley et al., which is assigned to the assignee of the present invention, discloses a document transport for an optical character recognition system (OCR). In this system a stack of documents is is loaded onto an elevator which lifts the document stack until the topmost document contacts a feed roller which pushes it between a set of separator rollers that make sure that only one document at a time is taken into the system. An alignment gate operating in conjunction with pinch rollers causes alignment of the document with the paper path. Next the document is moved at a controlled speed past an optically-sensitive device so that the characters printed thereon may be read by the system. Once the document has passed the reading station it is moved at high speed to either an accept or reject bin where it is stacked along with other documents.

The documents processed in the Daley et al. patent enter the accept or reject bins at high speed and hit the rear wall of the bin. They rebound from this collision and float down onto the stack of earlier documents in the bottom of the bin. When the documents are moving at high speed, it is possible for a following document to run into a rebounding document, whereby the orderly stacking of the documents is interrupted.

SUMMARY OF THE INVENTION

The present invention is directed to apparatus for stacking documents delivered at high speed to a bin such that they do not rebound and collide with following documents. This object is accomplished by having the documents impact with a device in the stacking bin that absorbs the kinetic energy of the document.

In an illustrative embodiment of the invention a stacker bin is provided in which documents enter it in free flight. These documents are driven by a pair of pinch rollers moving at high speed and are guided into a free flight path by a pair of guides. A number of bead chains are arranged across the flight path of the document, which chains have their lower ends fastened to the bin, and their upper ends passed over a bar and attached to weights.

When the document enters the stacker bin and contacts the bead chains, the chains are deflected, causing the weights to be lifted. Because the chain-weight system has a low natural frequency, the impact allows the kinetic energy of the document to be absorbed without imparting a significant rebound force on the document. During the absorbtion of the kinetic energy the leading edge of the document is retained in the recess between the beads of the chain at the height of the impact. When the energy has been absorbed, the document free falls onto the stack of previous documents.

In a preferred embodiment the bead chains are mounted at an angle so as to increase the clearance between the chain and the falling document. Thus, there is a reduced liklihood that the documents will form an uneven stack because of a second impact with the chain during its fall or because the leading edge of the document becomes hung up on the chain.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figure 1:
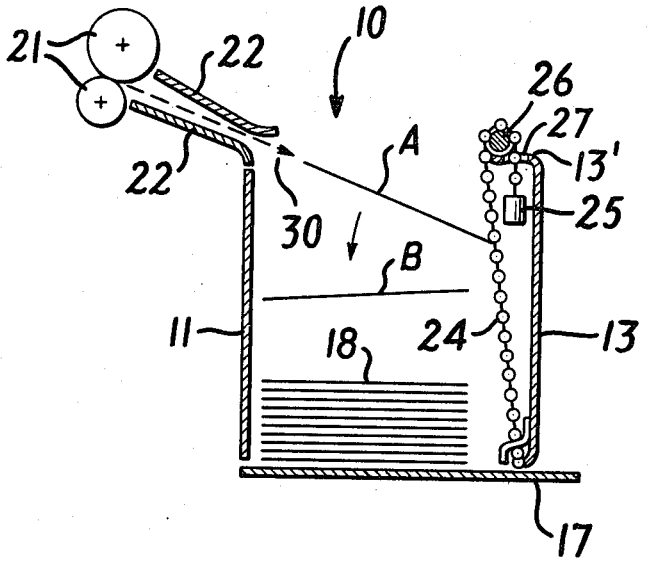
FIG. 1 is a schematic side view of a document stacker according to the present invention.
Figure 2:
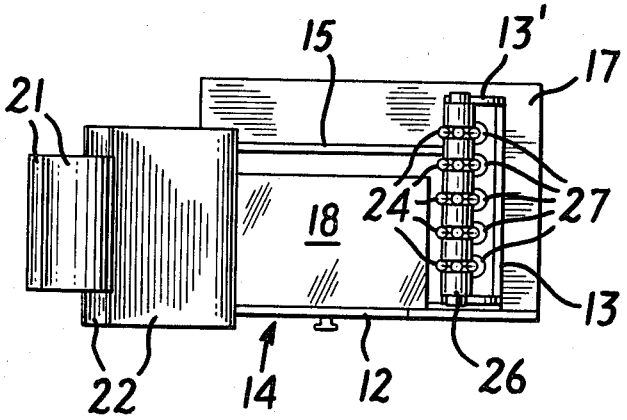
FIG. 2 is a schematic top view of the document stacker of FIG. 1.

In FIGS. 1 and 2 there is shown a document stacker that includes a bin 10 with a fixed front wall 11 and a movable rear wall 13. Fixed and adjustable side walls 14, 15 are provided along with a bottom wall 17. Fixed side wall 14 has a door 12 that may be opened so that a stack of documents 18 can be removed. The movable rear and side walls 13, 15 are adjusted in position to the size of the document being handled.

Documents are driven into bin 10 by high speed pinch rollers 21. Upon leaving the pinch rollers the documents are in a free flight path 30 defined by document guides 22. In the vicinity of the rear wall 13 the documents contact an energy absorbing device which is comprised of one or more bead chains 24, e.g. five such chains are shown in FIG. 2. Each of these chains has one end fastened to the lower edge of rear wall 13. The other ends of the chains are looped over a bar 26 positioned on a flange 13' at the top of the rear wall, pass through holes 27 in the flange 13 and are attached to individual weights 25. If desired, however, all of the chains can be fastened to a single weight. When individual weights are used the bar 26 is provided with grooves in it in order to receive the individual chains and to keep the weights apart. Since the rear wall flange 13', to which bar 26 is attached, projects away from the rear wall toward the front wall 11, the chains are positioned at an angle to the rear wall and to the free flight path 30 of the document.

The bead chains may be of any commercially available design, such as those manufactured by the Bead Chain Co. of Bridgeport, Conn., as Model No. 3. A typical bead chain of this type is made of stainless steel and has a tensile strength of 18 lbs. There are approximately 102 beads per foot and the beads have an approximate diameter of 0.092 inches.

As the document width increases the side wall 15 is adjusted outwardly, which means that more chains are contacted by the document (FIG. 2), thus compensating for the increased mass of the larger document. While five chains are shown in FIG. 2, the number of chains may be varied to compensate for various grades and weights of documents received in the bin. Also, the mass of weights 25 may be varied so as to absorb the energy of a given range of document masses with a given number of parallel bead chains, but the mass of the weights is generally in the range of $\frac{1}{3}$–1 oz.

In operation the document is moved into the stacker bin 10 along the free flight path 30 by the pinch rollers 21 and the guides 22. As its leading edge approaches the rear wall 13 of the bin, it impacts with and deflects the bead chains 24. This deflection causes the energy absorbing weights 25 to be lifted. While the weights are being lifted the leading edge of the document (shown in position A) is retained at the height of the impact by the recess between the beads in the chain at that point. When the energy has been absorbed the document (shown as position B) free falls onto the document stack 18 without significant recoil or bounce because the natural frequency of the chain-weight system is so low that it does not impart a significant rearward velocity to the document. This free fall is enhanced by the fact that the bead chains are mounted at an angle so as to increase the clearance between them and the document, and to prevent the leading edge of the document from hanging on the bead chains, both of which help to prevent the formation of an uneven document stack.

While the invention has been particularly shown and described with reference to a preferred embodiment thereof, it will be understood by those skilled in the art that various changes in form and details may be made therein without departing from the spirit and scope of the invention.

I claim:

1. A document stacking bin for receiving and stacking documents injected in a free flight path into the bin, wherein the improvement comprises:

at least one bead chain positioned across the flight path of the document so as to intercept its leading edge at a contact point, one end of said bead chain being fixed to the bin and the other end being looped over a portion of the bin; and at least one weight, said weight being attached to the end of the bead chain that is looped over a portion of the bin, the mass of the weight and chain being selected such that their combined natural frequency is so low that a significant rearward velocity is not imparted to the document after it is intercepted by the chain and the kinetic energy of the document is substantially absorbed.

2. A document stacking bin as claimed in claim 1, further including a pair of pinch rollers rotated at high speed followed by a pair of guide plates, said rollers and guide plates injecting the document into the bin along the free flight path.

3. A document stacking bin as claimed in claim 1, wherein said at least one bead chain is positioned at an angle to the free flight path of the document.

4. A document stacking bin as claimed in claim 1, wherein the bin includes a generally horizontal bottom on which the documents are stacked, the free flight document path is at angle to the horizontal bottom, the free flight path begins near a top front portion of the bin and extends downwardly towards a rear portion, and said at least one bead chain is located in the vicinity of said rear portion and is at an angle to the flight path and to the horizontal bottom such that an increasing amount of clearance exists between the chain and the document stack from the document contact point to the horizontal bottom.

5. A document stacking bin as claimed in claim 4, wherein the top front portion of the bin is at the top of a vertical fixed front wall, the rear portion is a vertical movable rear wall adjustable to particular document lengths, one end of the bead chain is fixed to the bottom of the rear wall, and the other end of the bead chain is looped over a grooved bar mounted on the top of the rear wall.

6. A document stacking bin as claimed in claim 5, wherein the stacking bin includes a vertical fixed side wall and a vertical movable side wall adjustable to particular document widths, the fixed side wall includes a door for removing a stack of documents.

7. A document stacking bin as claimed in claim 1, wherein there are a plurality of bead chains, each with its own weight, said plurality of bead chains being arranged across the free flight path of the document.

8. A document stacking bin as claimed in claim 1, wherein there are a plurality of bead chains which are attached to a single weight.

9. A document stacking bin for receiving and stacking documents injected in a downwardly-directed free flight path into the bin, said bin including a horizontal bottom plate on which a document stack is formed, a vertical fixed front wall in the vicinity of the origin of the flight path, a vertical movable rear wall adjustable to a particular document size and separated from the front wall in the direction of the flight path, a vertical fixed side wall spanning the distance between the front and rear walls and containing a door permitting a document stack to be removed, and a vertical movable side wall spanning the distance between the front and rear walls and being adjustable to a particular document size, wherein the improvement comprises:

a plurality of bead chains positioned across the flight path of the document so as to intercept its leading edge, one end of said bead chain being fixed to a lower edge of said rear wall;

a bar containing a plurality of grooves therein and being positioned at the top of the rear wall, each bead chain having one end looped over the bar and located in a respective one of its grooves; and a plurality of weights, one each being attached to a respective one of the ends of the bead chains looped over the bar, the masses of the weights being such that the kinetic energy of the document is substantially absorbed and no significant rebound is imparted to the document after impact with the chain.

10. A document stacking bin as claimed in claim 9, wherein the rear wall contains a flange projecting toward the front wall, said bar being positioned on said flange, whereby the bead chains are at an angle to the free flight path and to the horizontal bottom plate such that their is clearance between the document stack and the connection of the chains to the bottom of the rear wall.

* * * * *